United States Patent [19]

Cope

[11] 4,093,079

[45] June 6, 1978

[54] ROTARY COUPLER

[75] Inventor: Geoffrey Wilton Cope, Williamsville, N.Y.

[73] Assignee: Dresser Industries, Inc., Dallas, Tex.

[21] Appl. No.: 778,901

[22] Filed: Mar. 18, 1977

[51] Int. Cl.[2] ..... B61G 1/38

[52] U.S. Cl. ..... 213/62 A

[58] Field of Search ..... 114/249, 250; 213/12, 213/18, 62, 64, 67, 69, 72, 96–97, 120, 124, 174, 219; 46/216–218; 403/164–165

[56] References Cited

U.S. PATENT DOCUMENTS

| | | | |
|---|---|---|---|
| 295,482 | 3/1884 | Browning | 213/219 |
| 913,056 | 2/1909 | Rounds | 403/165 |
| 2,727,635 | 12/1955 | Blattner | 213/72 |
| 3,589,529 | 6/1971 | Altherr | 213/62 A |

*Primary Examiner*—Trygve M. Blix
*Assistant Examiner*—Jesus D. Sotelo
*Attorney, Agent, or Firm*—Raymond T. Majesko; John N. Hazelwood

[57] ABSTRACT

Rotary coupler for a railway car wherein a laterally extending cylindrical member with annular bosses is attached to the coupler butt and is received by the shank which has corresponding annular grooves and which is attached to the coupler head, to allow rotation of the cylindrical member within the shank while providing adequate strength and bearing.

7 Claims, 3 Drawing Figures

ROTARY COUPLER

BACKGROUND OF THE INVENTION

It has been found desirable in discharging the contents of a railway car to invert the body of the vehicle. Such an operation is usually carried out with an unloading device wherein the car body is rotated about a longitudinal axis through substantially 180° to effectively discharge granular or like materials from the car body of the hopper type. In such unloading operations, it is the practice to have the car being dumped remain coupled to adjacent upright railway vehicles.

Current designs of rotary couplers which rotate within the connecting yoke, are subject to torsional failure due to occasional jamming. Another drawback with rotary couplers has been their rapid wear rate, because of the lack of adequate bearing area at the swivel or rotary connection and vulnerability of the bearing surfaces to abrasive materials. Other problems facing rotary couplers are the need for special nonstandard yokes and draft rigging, the need for inbuilt detent means to prevent unwanted rotation of the coupler head and in some cases, the need for a special configuration of car draft sill and draft gear pocket. Further problems include difficult assembly and disassembly and restricted lateral angling capability.

U.S. Pat. No. 2,869,736 discloses a rotary coupler in which a shank rotates about a drawbar. It contains a single boss for bearing and requires a special detent.

U.S. Pat. Nos. 2,973,104 and 2,973,105 disclose a rotary coupler arrangement in which the entire coupler is rotated within the yoke 180° relative thereto.

U.S. Pat. No. 3,104,017 discloses a rotary coupler incorporating a cylindrical shank together with a slidable carrier which has a concave surface to fit the coupler shank and side positioned lugs on the carrier to prevent the shank from climbing off the carrier.

U.S. Pat. Nos. 3,157,290 and 3,157,291 disclose rotary couplers that utilize a special type of collar within the yoke to enable rotation of the entire coupler.

U.S. Pat. Nos. 3,220,562; 3,220,563; and 3,250,403 relate to a rotary coupler containing a means for detachably connecting the coupler shank to the head portion of a yoke to provide angular and/or rotational movements of the coupler relative to the yoke.

U.S. Pat. Nos. 3,589,529; 3,613,902; and 3,709,376 relate to other details concerning rotary couplers.

An object of the present invention is to provide a rotary coupler having a standard "F" coupler configuration that can be installed with the standard yoke, draft gear and striker arrangement.

Another object of the invention is to provide a rotary coupler having an improved bearing surface area particularly in the pull direction.

A further object of the invention is to provide a pivot for axial rotation of the coupler butt relative to the head and shank that is in line at all times.

Another object of the invention is to provide an enclosed pivot for axial rotation that can be permanently lubricated and protected from the entrance of abrasive material.

Yet another object of the invention is the provision of a rotary coupler that can be applied and removed in an identical manner to a standard "F" type coupler and require no special tools or equipment.

Another object of the invention is to provide a simple means of indicating for observation the amount of wear that has occured during service.

Still another object of the invention is to provide a rotary coupler with lateral and vertical angling capability identical to that of a standard "F" coupler.

A further object of the invention is to provide a rotary coupler that meets the latest AAR strength requirements.

A still further object of the invention is the provision of a coupler butt capable of rotating within the shank that does not require an inbuilt detent to hold the coupler head in normal running position.

Figure 1:
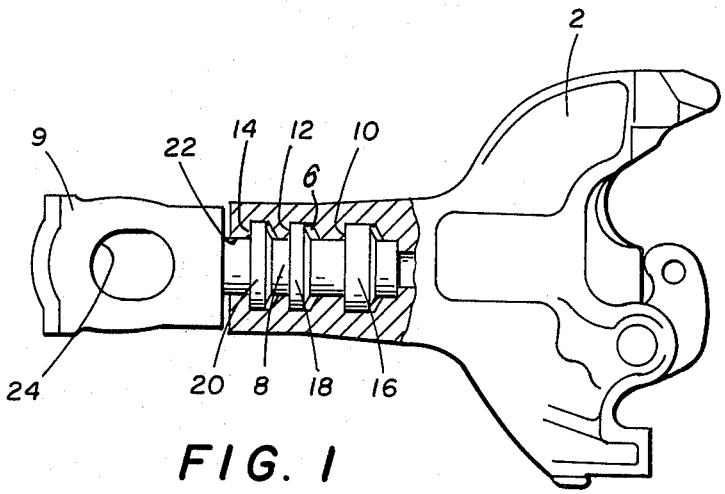
FIG. 1 is a plan view, partially in cross-section, of a rotary coupler according to the present invention.
Figure 2:
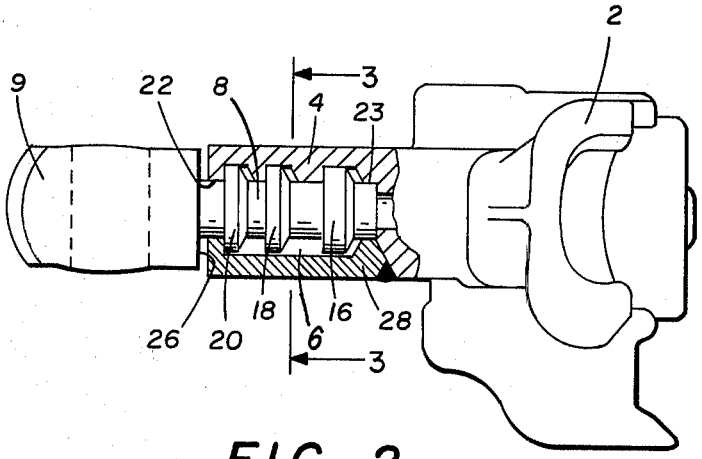
FIG. 2 is an elevation view, partially in cross-section, of the rotary coupler of the present invention.
Figure 3:
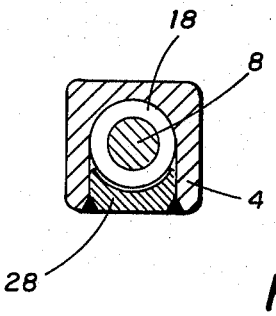
FIG. 3 is an elevation view, partially in cross-section, taken along line 3—3 of FIG. 2.

In accordance with the present invention, there is provided a rotary coupler for a railway car having a coupler head with a shank extending rearwardly therefrom. The shank contains an opening therein with a plurality of bearing surfaces. A coupler butt is contiguous with the end of the shank. The butt has a forwardly extending cylindrical member attached thereto which extends into the opening in the shank. This permits the cylindrical member to rotate within the coupler shank. The cylindrical member also contains a plurality of bosses cooperating with the bearing surfaces for sustaining draft and buff forces.

Referring to the drawings, there is shown a coupler head 2 which is a conventional type "F" coupler head. Extending rearwardly from the head is a coupler shank 4 which is preferably cast integral therewith.

The coupler shank 4 is provided with an elongated cavity 6 therein for accommodating a cylindrical member 8 which extends forwardly from the butt 9 of the coupler. This enables the cylindrical member 8 to rotate within the coupler shank 4. The reason for locating the rotary function within the shank, is that it may be used with any standard "F" coupler draft rigging and eliminates the need for a detent by taking advantage of the spring coupler carrier (not shown) for the purpose of preventing unwanted rotation.

The cavity 6 in the shank contains multiple bearing surfaces 10, 12 and 14 that contact in the draft (pull) direction. The cylindrical member which preferably is cast integral with the coupler butt, contains a plurality of annular bosses 16, 18 and 20 with bearing surfaces, all of which are larger in diameter than the cylindrical member. The front boss 16, closest to the coupler head, is larger in diameter than the other bosses 18 and 20. The fitting tolerances are so arranged that the front boss bearing surface only, would engage on the initial assembly. However, after a small increment of wear, the other bosses would progressively engage the other surfaces to provide adequate total bearing surface. Bearing surfaces 22 and 23 are provided within the shank so that the front and rear ends of the cylindrical member are journaled for rotation. The butt 9 contains an aperture 24 adjacent its end for accommodating a pin for connecting the coupler shank to a yoke in a conventional manner.

The cylindrical member 8 attached to the butt is introduced into the shank 4 through an opening 26 in the bottom of the shank. Alternatively, member 8 could be inserted through an opening in the top of the shank. After insertion, the bottom (or top) opening is sealed with a closure plate 28 or casting as by welding. The closure plate as shown, carries no bearing surfaces for cooperation with the bearing surfaces of the annular bosses on the cylindrical member 8, but such additional bearing surfaces could be provided.

It is intended that the foregoing description and drawings be construed as illustrative and not in limitation of the invention.

The embodiments of the invention in which an exclusive property or privilege is claimed are defined as follows:

1. A rotary coupler for a railway car comprising a coupler head having a shank extending rearwardly therefrom, said shank having an opening therein with a plurality of bearing surfaces, a coupler butt contiguous with the end of the shank, said butt having a forwardly extending cylindrical member attached thereto which extends into the opening in the shank wherein the cylindrical member may rotate within said shank and a plurality of spaced bosses on said cylindrical member cooperating with the bearing surfaces for sustaining draft and buff forces.

2. Coupler of claim 1, in which the bosses are annular and of larger diameter than the cylindrical member.

3. Coupler of claim 1, in which the opening in the shank is sealed with a separate closure member.

4. Coupler of claim 1, in which the shank is cast integral with the coupler head.

5. Coupler of claim 1, in which the cylindrical member is cast integral with the coupler butt.

6. Coupler of claim 1, in which the boss closest to the coupler head is of larger diameter than the other bosses.

7. A rotary coupler for a railway car comprising a coupler head having a shank extending rearwardly therefrom, said shank having an opening therein with a plurality of bearing surfaces, a coupler butt contiguous with the end of the shank, said butt having a forwardly extending cylindrical member attached thereto, which extends into the opening in the shank wherein the cylindrical member may rotate within said shank and a plurality of spaced bosses on said cylindrical member cooperating with the bearing surfaces for sustaining draft and buff forces, the boss closest to the coupler head being of larger diameter than the other bosses.

* * * * *